US006064039A

United States Patent [19]

Kumada

[11] Patent Number: 6,064,039

[45] Date of Patent: May 16, 2000

[54] GLOW PLUG WITH SMALL-DIAMETER SHEATH TUBE ENCLOSING HEATING AND CONTROL COILS

[75] Inventor: Chiaki Kumada, Gifu, Japan

[73] Assignee: NGK Spark Plug Co., Ltd., Nagoya, Japan

[21] Appl. No.: 09/290,894

[22] Filed: Apr. 14, 1999

[30] Foreign Application Priority Data

Apr. 15, 1998 [JP] Japan ..... 10-123001
Apr. 15, 1998 [JP] Japan ..... 10-123002

[51] Int. Cl.[7] ..... F23Q 7/00

[52] U.S. Cl. ..... 219/270; 123/145 A

[58] Field of Search ..... 219/270, 544; 123/145 A, 145 R; 361/264–266; 338/261

[56] References Cited

U.S. PATENT DOCUMENTS

| | | | |
|---|---|---|---|
| 4,380,973 | 4/1983 | Steinke | 123/145 A |
| 4,423,309 | 12/1983 | Murphy et al. | 219/270 |
| 4,549,071 | 10/1985 | Hatanaka et al. | 219/270 |
| 4,556,781 | 12/1985 | Bauer | 219/270 |
| 5,093,555 | 3/1992 | Dupuis et al. | 219/270 |
| 5,132,516 | 7/1992 | Hatanaka et al. | 219/270 |
| 5,206,483 | 4/1993 | Aota | 219/270 |

FOREIGN PATENT DOCUMENTS

| | | |
|---|---|---|
| 58-75627 | 5/1983 | Japan . |
| 58-145824 | 8/1983 | Japan . |
| 59-60125 | 4/1984 | Japan . |
| 60-66018 | 4/1985 | Japan . |
| 3-99122 | 4/1991 | Japan . |
| 5-242957 | 9/1993 | Japan . |

OTHER PUBLICATIONS

"International Standard (ISO) 7578"; Road vehicles—Sheath–type glow–plugs—General requirements and test methods; Second edition—Dec. 15, 1986; pp. 1–3.

*Primary Examiner*—John A. Jeffery

[57] ABSTRACT

A glow plug has a sheath heater, a heating coil and a control coil. The sheath heater has a sheath tube having a closed leading end. The heating coil is disposed adjacent to the leading end of a projection of the sheath tube beyond a main metal shell. The control coil is connected in series to the rear end of the heating coil and arranged to be heated by the heating coil to raise the electrical resistance to control the supply of electric power to the heating coil. The projection of the sheath tube has a substantially uniform outer diameter in the axial direction and the outer diameter is between 3.0 mm to 4.4 mm. Therefore, a temperature rising characteristic at the surface of the leading end of the sheath tube has a peak temperature TP in an initial stage of energization and saturates at a temperature not higher than the peak temperature TP.

29 Claims, 10 Drawing Sheets

*(PRIOR ART)*

GLOW PLUG WITH SMALL-DIAMETER SHEATH TUBE ENCLOSING HEATING AND CONTROL COILS

BACKGROUND OF THE INVENTION

1. Field of the Invention

The present invention relates to a glow plug that is used, for example, to pre-heat a diesel engine.

2. Description of the Related Art

In general, the glow plug incorporates a sheath heater having a sheath tube that is made of heat resisting metal. A heating coil constituted by a resistance heating wire is enclosed together with insulating powder. A main metal shell is joined to the sheath heater. A thread portion formed around the outer surface of the main metal shell is used to join the glow plug to the engine block of a diesel engine such that the heating portion formed at the leading end of the sheath heater is positioned in the combustion chamber. In this case, the temperature rising performance of the heater is usually required to have a so-called quick heating characteristic with which a saturated temperature can quickly be realized in order to improve the starting characteristic of the engine. It might be considered feasible to supply a large electric current to the heating coil in the initial stage of the energization to increase the temperature rising rate. However, excessive rise in the temperature of the coil easily takes place in this case, causing a problem of, for example, a breakage of the coil or melting of the sheath tube, to arise.

For example, in a glow plug disclosed in Unexamined Japanese Patent Publication (kokai) No. 59-60125, the glow plug incorporates a control coil made of a material having a positive temperature coefficient of resistance. The control coil is, in the sheath tube, disposed in series with the heating coil so as to improve the quick heating characteristic and prevent excessive rise in the temperature of the coil. In the glow plug having the above-mentioned structure, the control coil has a low temperature in the initial stage of the energization. Because the electric resistance is low, a relatively large electric current passes through the heating coil, thereby causing the heating coil to be heated quickly. When the temperature of the heating coil is raised, the control coil is heated with the heat of the heating coil so that the electric resistance of the control coil is raised. As a result, the electric current which is supplied to the heating coil is lowered. As a result, the temperature rising characteristic of the heater takes the form that the temperature is quickly raised in the initial stage of the energization. Then, the operation of the control coil reduces the supplied current so that the temperature is saturated.

In the above-mentioned publication, the following fact is described. Namely, excessive proximity between the heating coil and the control coil causes the resistance of the control coil to rapidly be raised. In this case, a sufficient time for which the large current is supplied to the heating coil in the initial stage of the energization is not permitted. Therefore, a satisfactory quick heating characteristic cannot necessarily be achieved. As a specific means for solving the above-mentioned problem, a structure is disclosed in which a gap having a length of about 1.5 P to 12 P is provided between the heating coil and the control coil on an assumption that the pitches of wound wires are P. In the above-mentioned publication, a gap of 2mm or larger is required to realize the quick heating characteristic if the outer diameter of the sheath tube is 5 mm and the wire pitches P are 0.6 mm.

In the above publication, it is preferable that a temperature rising characteristic for the glow plug is a characteristic indicated such that E is equal to 4.38. That is, the preferred characteristic is such that the temperature is monotonically raised in the initial stage of the energization after which the temperature is saturated without formation of a peak. However, the inventors of the present invention have found that the above-mentioned temperature rising characteristic is not necessarily a preferred characteristic for the glow plug of a diesel engine mounted on a vehicle.

A battery is employed to serve as a power source of the glow plug of a vehicle or the like. In this case, the glow plug is not always applied with a predetermined voltage (for example, 12 V) of the battery. Usually, a superimposed voltage applied from the alternator or the like is added to the voltage of the battery. Therefore, a voltage higher (for example, 14 V or lower) than the voltage of the battery is usually applied. If the raised voltage is applied as described above, the temperature rising characteristic of the heater raises a problem in that the temperature of the heater is raised excessively because the saturated temperature is raised in proportion to the applied voltage level. To prevent this problem, it is preferable that the temperature rising characteristic (hereinafter called an "excess-rise-preventive temperature rising characteristic") is realized in which a peak temperature is realized in the initial stage of energization after which the temperature is saturated at a level lower than the peak temperature. It should be noted that the above publication teaches that this temperature rising characteristic is not a preferred characteristic (the characteristic indicated such that $\epsilon$=6.25 shown in FIG. 10 attached to the disclosure).

The contents of Unexamined Japanese Patent publication (kokai) No. 59-60125 will now be rethought with this fact in mind. If the outer diameter of the sheath tube is 5 mm and the wire pitches Pare 0.6 mm, the above-mentioned excess-rise-preventive temperature rising characteristic can be realized only when a large gap not shorter than 5 mm is provided between the coils as can be understood from FIG. 7 attached to the publication. If the gap between the coils is longer than 6 mm which is somewhat longer than the above-mentioned value, the temperature of the heating coil is excessively raised. The facts state that a stable excess-rise-preventive temperature rising characteristic cannot easily be provided for the glow plug by adjusting the gap between the coils.

In view of the above, available glow plugs have a structure as shown in FIG. 9 formed such that a portion of a sheath tube 100 for accommodating a control coil 102 has a diameter larger than that of a portion of the sheath tube 100 for accommodating a heating coil 101 so as to enlarge the thermal capacity of the portion. Thus, rapid rise in the temperature of the control coil 102 is prevented so as to realize the above-mentioned excess-rise-preventive temperature rising characteristic (refer to, for example, Unexamined Japanese Patent Publication (kokai) No. 3-99122).

In recent years, increase in the performance of diesel engines and size reduction of the same have raised a requirement for a small sheath heater for the glow plug. Thus, the outer diameter of the projection of the sheath tube over the main metal shell is reduced to be smaller than 5 mm. If the outer diameter of the portion of the sheath tube 100 for accommodating the enlarged control coil 102 is made to be smaller than 5 mm, the portion for accommodating the heating coil 101 is made to be even smaller than that value. As a result, the mechanical strength of the portion becomes insufficient. When a shock is exerted, the portion easily broken. What is worse, the outer diameter of the heating coil is too small to obtain a satisfactory increased heating performance. Therefore, when a sheath heater having a small diameter is required, it is preferable that the sheath tube has a simple shape for the purpose of preventing the above-mentioned problems. That is, it is preferable that the shape is formed such that the portions for accommodating the heating coil and the control coil have similar outer diameters. The simple shape of the projection of the sheath tube is as well advantageous to widen the design freedom of the engine head on which the glow plug is mounted.

However, in accordance with the contents of the above-mentioned disclosure, it is substantially impossible to use the sheath tube having a simple shape in which the diameter of the portion for accommodating the control coil is not enlarged and which is shown in FIG. 6 to realize a satisfactory excess-rise-preventive temperature rising characteristic. That is, the reduction in the diameter of the sheath tube and realization of the excess-rise-preventive temperature rising characteristic cannot easily be made to be compatible with each other. Therefore, a glow plug incorporating a sheath heater in which the outer diameter of the sheath tube is 5 mm or smaller and which has a representative excess-rise-preventive temperature rising characteristic has not been realized.

SUMMARY OF THE INVENTION

An object of the present invention is to provide a glow plug incorporating a sheath heater having a representative excess-rise-preventive temperature rising characteristic, in which the outer diameter of the sheath tube can be reduced to be smaller than 5 mm.

According to the present invention, a glow plug comprises:

a sheath tube having a closed leading end; a cylindrical main metal shell disposed on the outside of said sheath tube, said sheath tube having a projecting portion in a leading end of said sheath tube projecting over said main metal shell; and a plurality of resistance-wire coils disposed in the axial direction in said sheath tube, said resistance-wire coils including a heating coil and a control coil in a portion of said sheath tube projecting over said main metal shell, said heating coil being disposed adjacent to the leading end of the projecting portion, said control coil being connected to the rear end of said heating coil in series and arranged to be heated by said heating coil to raise electric resistance so as to control the supply of electric power to said heating coil; wherein said projecting portion of said sheath tube has substantially the same outer diameter in the axial direction and the outer diameter is in the range of 3.0 mm to 4.4 mm so that a temperature rising characteristic at the surface of the leading end of said sheath tube is made to have a peak temperature TP in an initial stage of energization and made to be saturated at a temperature not higher than the peak temperature TP.

DETAILED DESCRIPTION OF THE INVENTION

Figure 1:
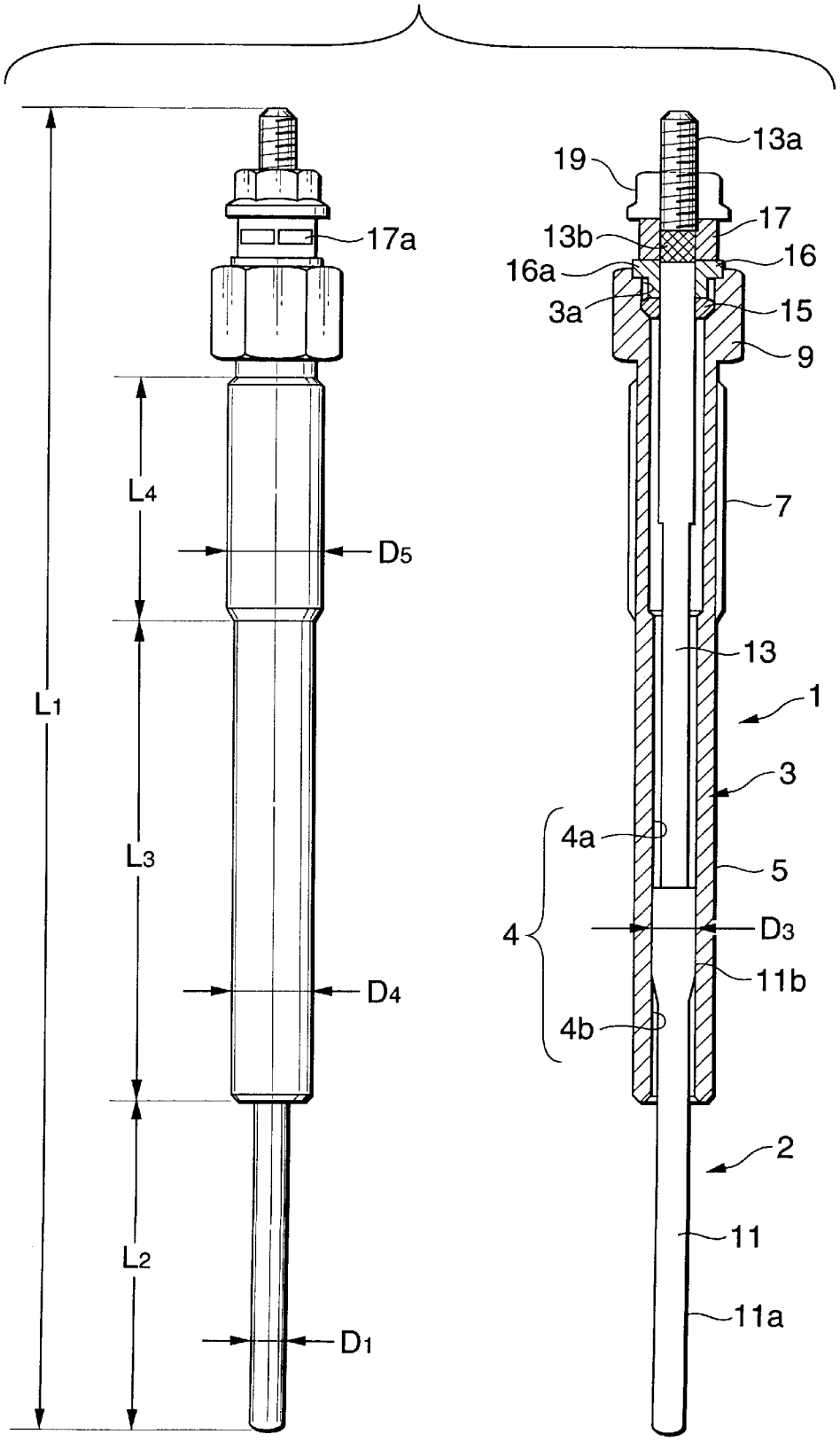
FIG. 1 is an overall view and a vertical cross sectional view showing an embodiment of a glow plug according to the present invention.

A detailed description of the present invention will be described as follows.

A glow plug according to the present invention has a sheath tube, a cylindrical main metal shell, and a plurality of resistance-wire coils. The sheath tube has a closed leading end. The cylindrical main metal shell is disposed on the outside of the sheath tube in a state in which the leading end of the sheath tube projects over the main metal shell. The plurality of resistance-wire coils are disposed in the axial direction in the sheath tube.

The resistance-wire coils include a heating coil and a control coil in a portion of the sheath tube projecting over the main metal shell. The heating coil is disposed adjacent to the leading end of the projecting portion. The control coil is connected to the rear end of the heating coil in series and arranged to be heated by the heating coil to raise its electric resistance so as to control the supply of electric power to the heating coil. The projecting portion of the sheath tube has substantially the same outer diameter in the axial direction. The outer diameter of the projecting portion is in the range of 3.0 mm to 4.4 mm so that a temperature rising characteristic at the surface of the leading end of the sheath tube is made to have a peak temperature TP in an initial stage of energization and made to be saturated at a temperature not higher than the peak temperature TP.

That is, there is common sense that the excess-rise-preventive temperature rising characteristic of the glow plug can be realized only when the portion of the sheath tube to accommodate the control coil has a large diameter. This fact applies to a small-diameter heater incorporating a sheath tube which has an outer diameter smaller than 5 mm. However, energetic investigations of the inventors of the present invention resulted in finding the following fact. That is, when the outer diameter of the projection of the sheath tube for accommodating the heating coil and the control coil is reduced to be 4.4 mm or smaller, setting of the outer diameter to be a specific value in the present invention, that is, to be 4.4 mm or smaller permits the projection of the sheath tube to have a substantially uniform outer diameter in the axial direction. In this case, a satisfactory excess-rise-preventive temperature rising characteristic can be relized, that is, a temperature rising characteristic which has a peak temperature TP in the initial stage of energization and the temperature is saturated at a level not higher than the peak temperature TP. Thus, the present invention is established.

As a result, the two requirements which have been considered to be very difficult to be achieved simultaneously from the viewpoint of the present technical common sense, that is, size reduction of the sheath tube and realization of an excess-rise-preventive temperature rising characteristic, can simultaneously be achieved. Thus, a long-life glow plug that is free from an easily occurring excess rise in the temperature can be realized even if the glow plug has a small size to be adaptable to the diesel engine or the like, the performance of which is improved and the size of which is reduced. When the diameter of the sheath tube is reduced to 4.4 mm or smaller, further smooth rising of the temperature can be realized. Therefore, an effect can be obtained in that the quick heating characteristic is further improved.

On the other hand, the size of the portion of the projection of the sheath tube for accommodating the heating coil is made to be substantially the same as the size of the portion for accommodating the control coil. That is, the diameter is not reduced. As a result, satisfactory mechanical strength of the portion can be realized. Even if a shock is exerted, breakage does not easily take place. In addition, a sufficiently large outer diameter of the heating coil can be maintained because the diameter is not reduced. Therefore, satisfactory heating performance can be obtained. Since the shape of the projection of the sheath tube is simplified, the design freedom of the engine block, to which the glow plug is mounted, can be widened advantageously.

If the outer diameter of the sheath tube is smaller than 3.0 mm, the outer diameter of the heating coil is reduced excessively to obtain a required heating performance. If the outer diameter is larger than 4.4 mm, the required excess-rise-preventive temperature rising characteristic cannot be realized. It is preferable that the outer diameter is 3.5 mm to 4.0 mm.

The reason why the reduction in the outer diameter of the sheath tube to be smaller than 4.4 mm realizes the satisfactory excess-rise-preventive temperature rising characteristic will now be described. When the diameter of the sheath tube is reduced as described above, heat radiation from the surface of the sheath tube is enhanced. As a result, heat transfer from the heating coil to the control coil is adequately prevented. Thus, even if the distance between the two coils is somewhat shortened, excessively rapid heating of the control coil can be prevented. Therefore, a stable control of energization can easily be performed. Note that the projection of the sheath tube may be formed into a cylindrical shape having substantially constant outer diameters (if the leading end of the tube is rounded, the structure is formed such that the constant outer diameter is realized except for the rounded portion).

The control coil may directly be connected to the rear end of the heating coil at a position apart from the rear end for a gap larger than each of the pitches of the winding of a wire for forming the heating coil. In this case, it is preferable that the length of the gap is adjusted to 0.8 mm to 3 mm. If the size of the gap between the coils is larger than 3 mm, the heating coil cannot smoothly heat the control coil. Thus, excess heating of the heating coil easily takes place. If the size of the gap between the coils is smaller than 0.8 mm, the level of the resistance of the control coil is rapidly raised. Thus, the quick heating characteristic cannot be maintained. What is worse, the saturated temperature is lowered excessively to obtain satisfactory heating performance. In the present invention, the gap between the coils is defined as the distance in the axial direction of the coil between a position shifted along the heating coil from the junction between the heating coil and the control coil for a distance corresponding to a half winding and a position similarly shifted toward the control coil for a distance corresponding to a half winding.

Figure 7:
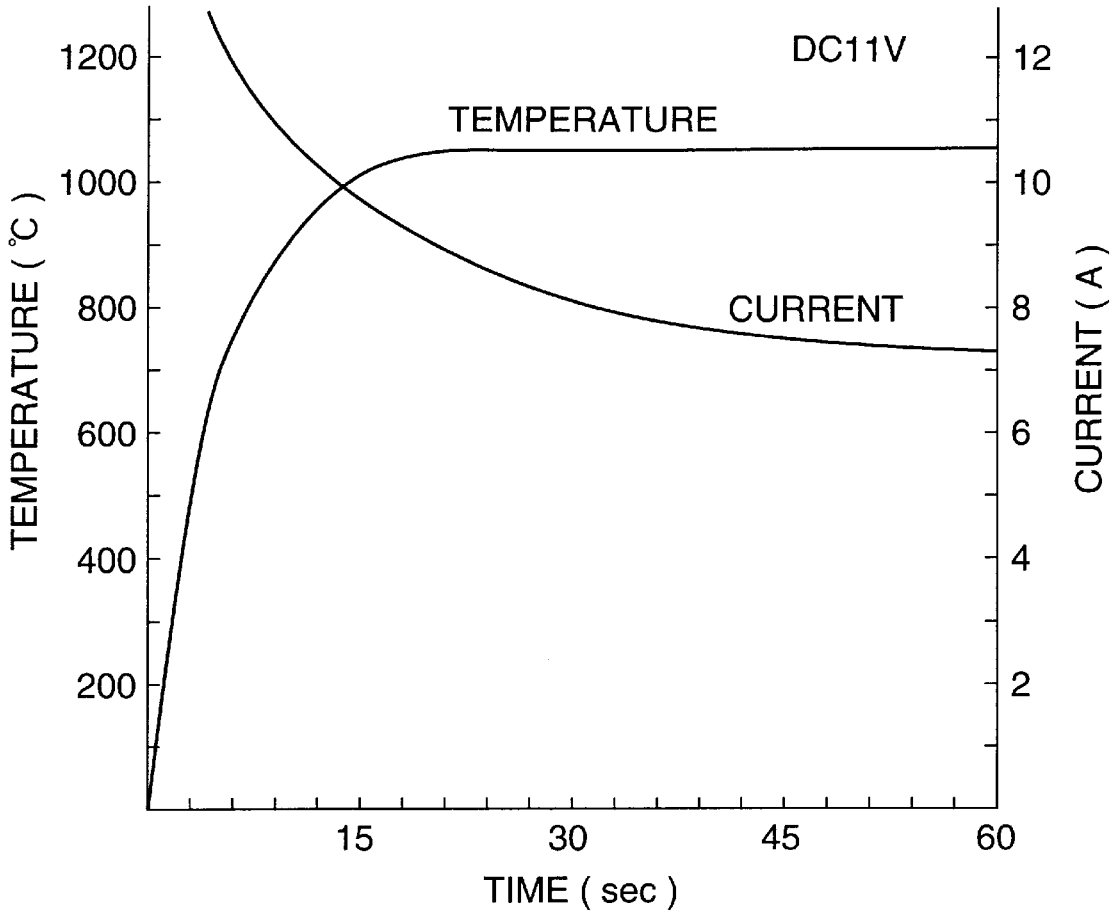
FIG. 7 is a graph showing a temperature rising curve of glow plug number 1 according to Example 1.

The size of the gap is smaller than the size of the gap (about 5 mm as shown in FIG. 7) which is required for the glow plug disclosed in Unexamined Japanese Patent Publication (kokai) No. 59-60125 and incorporating a sheath tube having an outer diameter of 5 mm to obtain the excess-rise-preventive temperature rising characteristic. It is shown that enhancement of the heat radiation from the surface of the tube caused by the reduction in the diameter of the sheath tube prevents heat transfer from the heating coil to the control coil. Therefore, it is advantageous for the glow plug according to the present invention and having the sheath tube which has a small diameter to somewhat shorten the distance between the two coils as compared with the conventional glow plug having a large diameter when a satisfactory excess-rise-preventive temperature rising characteristic is obtained.

It is further preferable that the length of the gap between the coils is 1 mm to 2 mm.

It is preferable that the peak temperature TP is 900° C. to 1150° C. If the peak temperature TP is lower than 900° C., there is apprehension that heating becomes insufficient to satisfactorily perform pre-heating of the engine. If the peak temperature TP is higher than 1150° C., heating is performed excessively. In this case, there is apprehension that the lifetime of the heating coil is shortened. It is preferable that the peak temperature TP is 950° C. to 1050° C.

It is preferable for the glow plug that the difference TP−TS between the peak temperature TP and temperature TS realized 60 seconds after the energization is started is 50° C. to 200° C. when the temperature rising characteristic is measured with an applied voltage of 11 V at room temperature. If the difference TP−TS is lower than 50° C., the heater is excessively heated when the applied voltage is raised. If TP−TS is higher than 200° C., the saturated temperature is lowered excessively. Thus, required heating performance cannot be obtained. It is preferable that TP−TS is 80° C. to 150° C.

To achieve the required quick heating characteristic, it is preferable, for the glow plug according to the present invention, that the peak temperature TP is 800° C. or higher and energizing time t800 required for the temperature to be raised to 800° C. is 8 seconds or shorter, more preferably, 5 seconds or shorter, when the temperature rising characteristic is measured with an applied voltage of 11 V at room temperature.

It is preferable for the glow plug according to the present invention that thickness t of the projection of the sheath tube over the main metal shell is 0.3 mm to 0.75 mm and the value of t/D1 is 0.08 to 0.2 on an assumption that the outer diameter is D1. If the thickness t is smaller than 0.3 mm, the strength of the sheath tube becomes insufficient. If a shock is exerted due to dropping or the like which occurs at a joining operation, the heater is easily broken. Since the outer diameter of the sheath tube is limited to be 4.4 mm or smaller in the present invention, the inner diameter of the sheath tube is made to be too small if the thickness t is larger than 0.75 mm. In this case, a satisfactory large diameter of the heating coil cannot be maintained to obtain required heating performance. As a matter of course, short circuit easily occurs between the inner surface of the sheath tube and the heating coil and between the inner surface and the control coil if the diameter of the heating coil is enlarged forcibly. Therefore, it is preferable that the thickness t satisfies a range from 0.45 mm to 0.6 mm.

When an assumption is made that the inner diameter of the projection of the sheath tube is D2 and the outer diameter of each of the heating coil and the control coil is d1, it is preferable that the difference CG=(D2−d1)/2 between the two radii satisfies a range from 0.1 mm to 0.8 mm. If CG is shorter than 0.1 mm, short circuit easily occurs between the inner surface of the sheath tube and the heating coil and between the inner surface and the control coil. What is worse, the heating performance sometimes deteriorates. If CG is longer than 0.8 mm, a process for enclosing the heating coil and the control coil together with an insulating material (for example, magnesia powder) to perform a forging process so as to reduce the diameter easily encounters meander of the coil in the sheath tube. Similarly, in this case, short circuit easily occurs. Therefore, it is preferable that the value of CG satisfies a range from 0.2 mm to 0.6 mm.

It is preferable that the outer diameter d1 of each of the heating coil and the control coil be 1.5 mm to 3.0 mm. If the outer diameter d1 is smaller than 1.5 mm, a required heating performance cannot sometimes be obtained. If the outer diameter d1 is larger than 3.0 mm, the thickness t is reduced excessively because the outer diameter of the sheath tube is limited to be 4.4 mm or smaller. In this case, there arises a problem in that the strength is insufficient. It is preferable that the ratio d1/D2 of the outer diameter d1 of the coil and the inner diameter D2 of the sheath tube satisfies a range from 0.5 to 0.8. If d1/D2 is higher than 0.8, the heating performance sometimes deteriorates. Moreover, short circuit easily occurs between the inner surface of the sheath tube and the heating coil and between the inner surface and the control coil. If d1/D2 is lower than 0.5, the coil easily meanders in the tube, similarly causing short circuits to easily occur.

The sheath tube may be made of any one of stainless steel, iron-base heat resisting alloy and Ni-base heat resisting alloy. When the sheath tube which is directly exposed to a hot gas flow is made of the material, the durability of the sheath tube can be improved. In the present invention, the stainless steel may be any one of various types of austenitic stainless steel materials because of excellent corrosion resistance.

If excellent heat resistance is required, Ni-base heat resisting alloy, for example, Ni-base refractory alloy, such as Inconel 601 (Inconel is trade name), may be employed. When the glow plug is used in an environment, such as a high-speed injection type diesel engine, in which the swirl flow velocity is high, austenitic stainless steel containing Ni in a large quantity (for example, SUS310S) oraustenitic heat resisting steel (for example, SUH309, SUH310 or SUH330) having a similar composition may be employed in order to prevent exhaustion due to oxidation caused by the high-speed gas flow.

The material of the heating coil may be a material similar to that of a known glow plug. For example, any one of iron-chrome alloys (for example, an alloy mainly composed of iron and containing chrome by 13 wt % to 30 wt %) or nickel-chrome alloy (for example, alloy mainly composed of nickel and containing chrome by 8 wt % to 22 wt %) may be employed. The material of the control coil may be a material having a temperature coefficient of the electric specific resistance larger than that of the heating coil. For example, cobalt-iron alloy (an alloy mainly composed of cobalt and containing iron by about 6 wt % to about 18 wt %) may be employed because of its excellent durability. As an alternative to this, nickel-plated iron wire or a nickel wire may be employed.

The material, the diameter of the wire, and the length of each of the heating coil and the control coil are appropriately selected. Thus, assuming that the electric resistance of the heating coil is RH and the electric resistance of the control coil is RC, an electric resistance ratio (RH/RC) RT at room temperature is one or greater. Moreover, the value of the electric resistance (RH/RC) 800 at 800° C. is 0.1 to 0.4. If the value of (RH/RC) RT is smaller than one, a satisfactory quick heating characteristic of the heater cannot sometimes be realized. If the value of (RH/RC) 800 is smaller than 0.1, the control coil excessively controls the energization. In this case, the heating coil cannot sometimes generate heat. If (RH/RC) 800 is higher than 0.4, the effect of controlling the energization which is performed by the control coil becomes in sufficient. In this case, the heating coil is easily excessively heated.

It is preferable that the length of the projection of the sheath tube over the main metal shell be 24 mm to 50 mm. If the length of the projection is shorter than 24 mm, a sufficiently large space in the projection for accommodating the heating coil and the control coil cannot be obtained. It leads to a fact that a length of the coils for obtaining a predetermined temperature rising characteristic (or heating performance) cannot sometimes be provided. If the above-mentioned length is longer than 50 mm, the strength of the projection becomes insufficient because the sheath tube has a small diameter of 4.4 mm or smaller. If a shock or the like is exerted, breakage easily occurs. Therefore, it is preferable that the length of the projection be 28 mm to 40 mm.

In the glow plug, the resistance-wire coils (the heating coil and the control coil) disposed in the sheath tube are usually supplied with electric power through an energizing terminal shaft inserted into the sheath tube from the base end of the sheath tube. In this case, the leading end of the energizing terminal shaft may be connected to the rear end of the resistance-wire coil. Moreover, the leading end of the energizing terminal shaft may be projected over the end surface of the main metal shell. If lateral force is exerted to the projection of the sheath tube, a strong bending force is easily concentrated on the position at which the projection and the inner surface of an opening of the main metal shell are made to be in contact with each other. Therefore, the leading end of the energizing terminal shaft is projected over the end surface of the main metal shell to reinforce the contact portion of the sheath tube. Therefore, resistance against bending can be raised. In this case, force is concentrated on the sheath tube when the bending force is exerted at a position adjacent to the leading end of the energizing terminal shaft. Therefore, it is preferable that the length from this position to the leading end of the sheath tube is 24 mm to 50 mm, more preferably 24 mm to 42 mm.

If the outer diameter of the sheath tube of the glow plug is reduced, the ease of joining the sheath tube to the main metal shell sometimes deteriorates. In this case, the inner diameter of the opening formed in the main metal shell in which the sheath tube is positioned is made to be larger than the portion of the sheath tube for accommodating the heating coil and the control coil. Moreover, the base end of the sheath tube is enlarged to correspond to the inner diameter of the opening formed in the main metal shell. Thus, the enlarged portion is joined to the inside portion of the main metal shell by brazing, welding or press-fitting. Since the base end of the sheath tube is enlarged so as to be joined to the main metal shell at the enlarged portion, the ease of joining can be improved.

The preferred embodiment of the present invention will now be described with reference to the drawings.

Figure 2A:
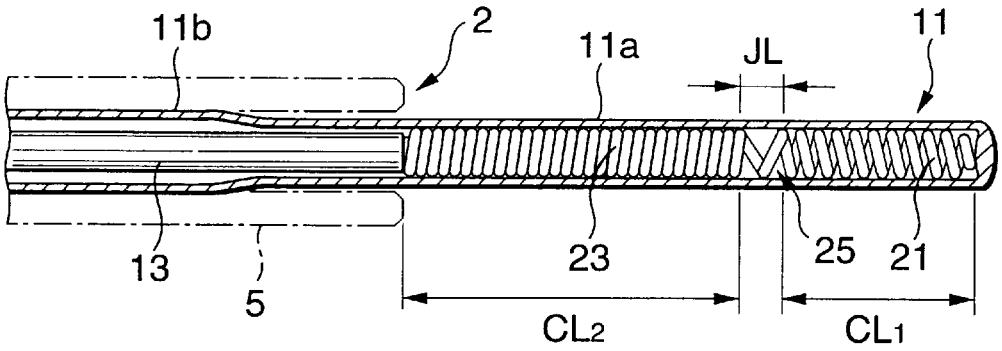
FIG. 2A is a cross sectional view and an enlarged schematic view showing an essential portion of the internal structure of a sheath tube of the glow plug.
Figure 2B:
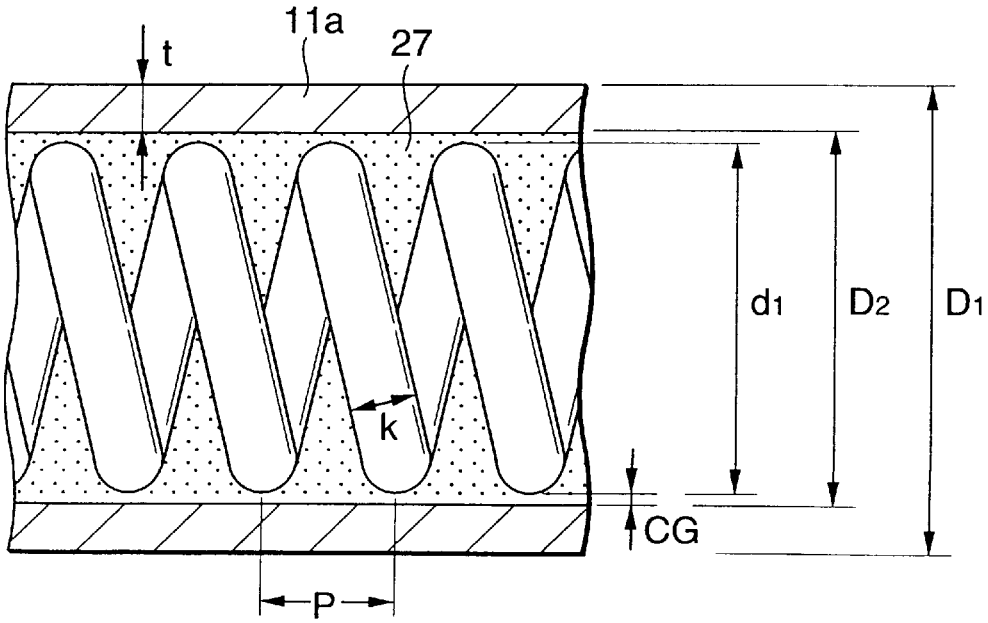
FIG. 2B is an enlarged view of FIG. 2A.

FIG. 1 is an overall view showing an example of a glow plug according to the present invention and a vertical cross sectional view of the glow plug. The glow plug 1 incorporates a sheath heater 2 and a main metal shell 3 disposed on the outside of the sheath heater 2. As shown in FIGS. 2A and 2B, the sheath heater 2 has a sheath tube 11 which has a closed leading end and in which two resistance-wire coils, that is a heating coil 21 disposed adjacent to the leading end of the sheath tube 11 and a control coil 23, in series, connected to the rear end of the heating coil 21 by welding or the like are enclosed. The two coils 21 and 23 are enclosed together with magnesia powder 27 serving as an insulating material.

As shown in FIG. 1, a main body 11*a* of the sheath tube 11 for accommodating the heating coil 21 and the control coil 23 has a leading end projecting over the main metal shell 3 so that a projection is formed. The main body 11*a* is formed into a cylindrical shape having a substantially constant outer diameter D1 (however, the leading end is rounded). The outer diameter D1 is 3.0 mm to 4.4 mm (preferably 3.5 mm to 4.0 mm). The heating coil 21 is electrically connected to the sheath tube 11 at the leading end thereof. The outer surfaces of the heating coil 21 and the control coil 23 and the inner surface of the sheath tube 11 are insulated from each other by dint of presence of magnesia powder 27.

Referring to FIGS. 2A and 2B, the heating coil 21 is made of a material having electric specific resistance ρ20 at 20° C. which is 80 μΩ·cm to 180 μΩ·cm and ratio ρ800/ρ20 of about 0.9 to about 1.2 on an assumption that the electric specific resistance at 800° C. is ρ800. Specifically, the material is iron-chrome alloy wire or a nickel-chrome alloy wire. The diameter k of the wire forming the coil is 0.15 mm to 0.4 mm, the coil length CL1 is 5 mm to 12 mm, the coil outer diameter d1 is 1.5 mm to 3.0 mm, the wire pitches are 0.2 mm to 0.8 mm and the number N of wire turns is 8 to 15.

The control coil 23 is made of a material having the electric specific resistance ρ20 at 20° C. which is 5 μΩ·cm to 25 μΩ·cm and a ratio ρ800/ρ20 of about 7 to about 12 on an assumption that the electric specific resistance at 800° C. is ρ800. Specifically, the material is iron-chrome alloy wire or nickel-chrome alloy wire. The diameter k of the wire forming the coil is 0.17 mm to 0.3 mm, the coil length CL2 is 10 mm to 32 mm, the coil outer diameter d1 is 1.5 mm to 3.0 mm, the wire pitches are 0.2 mm to 0.8 mm, and the number N of wire turns is 25 to 40.

Each of the heating coil 21 and the control coil 23 are adjusted to have an electric resistance ratio (RH/RC) RT at room temperature of one or greater on an assumption that the electric resistance of the heating coil is RH and the electric resistance of the control coil is RC. Moreover, the value of the electric resistance (RH/RC) 800 at 800° C. is 0.1 to 0.4. A gap is formed between the heating coil 21 and the control coil 23, the gap being greater than the wire pitch of the heating coil 21. The size JL of the gap 25 between the coils is 0.8 mm to 3 mm, preferably 1 mm to 2 mm. That is, the size of the gap 25 corresponding to the wire pitch P of the heating coil 21 is 0.2 pitch to 0.8 pitch (preferably 0.3 pitch to 0.6 pitch).

The sheath tube 11 has the main body 11*a* and an enlarged-diameter portion 11*b* having a diameter larger than that of the main body 11*a* and formed adjacent to the base end of the sheath tube 11. The thickness t of the main body 11*a* is 0.3 mm to 0.75 mm (preferably 0.45 mm to 0.6 mm). Moreover, the value of t/D1 is 0.08 to 0.2 (preferably 0.11 to 0.17). Assuming that the inner diameter of the main body 11*a* is D2 and the outer diameter of each of the heating coil 21 and the control coil 23 is d1, the value of the radius difference CG=(D2−d1)/2 is 0.1 mm to 0.8 mm (preferably 0.2 mm to 0.6 mm). A ratio d1/D2 of the outer diameter d1 of each of the coils 21 and 23 and the inner diameter D2 of the main body 11*a* is 0.5 to 0.8 (preferably 0.6 to 0.7).

A rod-shape energizing terminal shaft 13 is inserted into the sheath tube 11 from the base end of the sheath tube 11. The leading end of the energizing terminal shaft 13 is connected to the rear end of the control coil 23 by welding or the like. On the other hand, a male-thread portion 13*a* is formed in the rear end portion of the energizing terminal shaft 13, as shown in FIG. 1.

The sheath heater 2 having the above-mentioned structure can be manufactured, for example, as follows. As shown in FIG. 3B, the heating coil and the control coil are, together with magnesia powder, enclosed in a sheath tube 11' having a diameter larger than the final diameter by an estimated value of reduction caused in the machining process. In the state, the sheath tube 11' is subjected to a rotational forging process (a swaging process) so that the main body 11*a* and the enlarged-diameter portion 11*b* are formed.

Figure 3A:
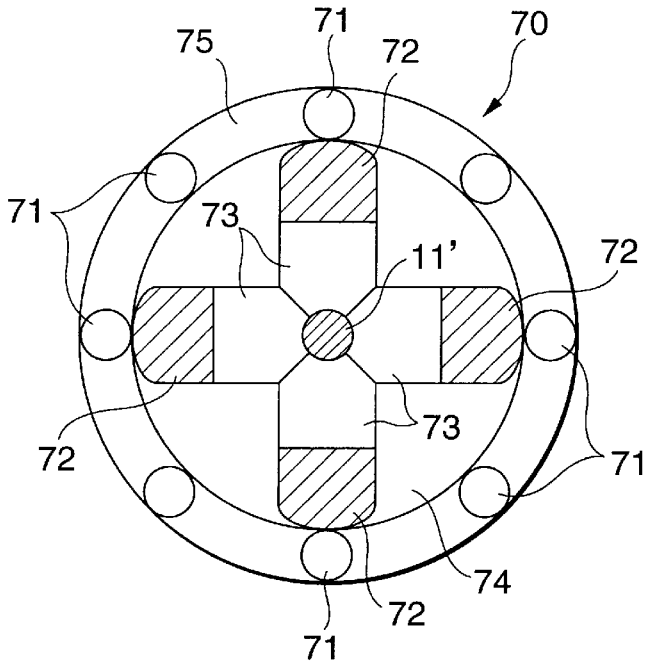
FIGS. 3A and 3B are diagrams showing a concept of a swaging machine and a swaging operation.
Figure 3B:
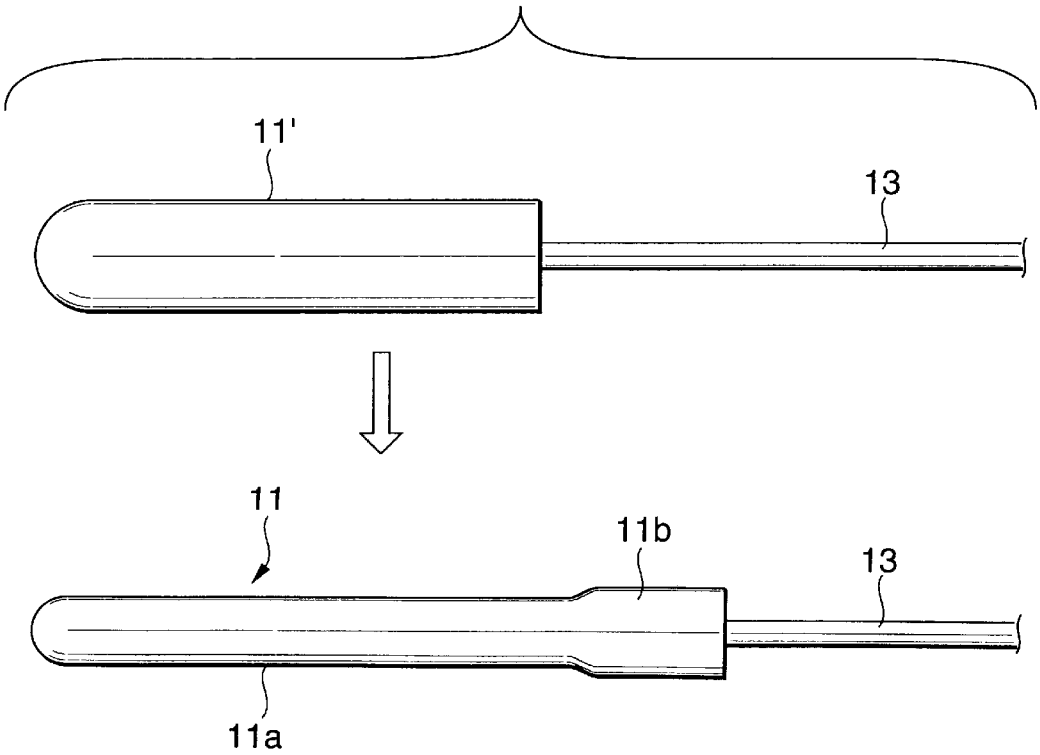

The swaging process can be performed by using a swaging machine 70 structured, for example, as shown in FIG. 3A. The swaging machine 70 incorporates a plurality of dice 73 disposed around the sheath tube 11' and supported by corresponding hammers 72. The dice 73 are disposed in a main rotational shaft 74 so as to integrally be rotated. The main rotational shaft 74 is rotated in a cage 75 having a plurality of rollers 71 made of hardened steel. When the hammers 72 have been moved to the positions of the rollers 71 while the hammers 72 are being rotated together with the main rotational shaft 74, the dice 73 are compressed. When the hammers 72 are moved to the positions among the adjacent rollers 71, the dice 73 are opened by dint of the centrifugal force. Therefore, when the number of revolutions of the main rotational shaft 74 is made to be larger than a predetermined value, the compressing process using the dice 73 can be repeated.

The main metal shell 3 is formed into a cylindrical shape having a through hole 4 formed in the axial direction, as shown in FIG. 1. The sheath heater 2 is inserted from either end of the opening so as to be secured in a state in which the leading end of the sheath tube 11 projects for a predetermined length. A tool engagement portion 9 having a hexagonal cross sectional shape to which a tool, such as a torque wrench or the like, for joining the glow plug 1 to the diesel engine is engaged is formed in the outer surface of the main metal shell 3. Moreover, a joining thread portion 7 is formed to be continued from the tool engagement portion 9.

The through hole 4 of the main metal shell 3 has an enlarged-diameter portion 4*b* positioned adjacent to an opening over which the sheath tube 11 projects and a small-diameter portion 4*a* formed to be continued from the enlarged-diameter portion 4*b*. The enlarged-diameter portion 11*b* formed adjacent to the base end of the sheath tube 11*b* is press-fit into the small-diameter portion 4*a* so as to be secured. On the other hand, a countersunk portion 3*a* is formed in the opposite opening of the through hole 4. A rubber "O" ring 15 (made of, for example, nylon) and an insulating bushing 16 fitted to the outer surface of the energizing terminal shaft 13 are received in the countersunk portion 3*a*. Moreover, a retaining ring 17 for preventing separation of the insulating bushing 16 is fitted to the energizing terminal shaft 13 in the rear of the countersunk portion 3*a*. The retaining ring 17 has a crimping portion 17*a* formed on the outer surface thereof so as to be secured to the energizing terminal shaft 13. A knurled portion 13*b* for enlarging the crimping force is formed in the corresponding surface of the energizing terminal shaft 13. Reference numeral 19 represents a nut for securing a power supply cable to the energizing terminal shaft 13.

A projection length L2 of the sheath tube 11 over the main metal shell 3 is 24 mm to 50 mm (preferably 28 mm to 40 mm). As shown in FIG. 2, the position of the leading end of the energizing terminal shaft 13 substantially coincides with the position of the end surface of the opening of the main metal shell 3.

Dimensions and so forth of the glow plug 1 shown in FIG. 1 will now be described (also refer to FIGS. 2A and 2B).

*Overall Length L1=145 mm (Heating Coil 21)

*Material: iron-chrome alloy (composition: Al=7.5 wt %; Cr=26 wt %, Fe=balance, ρ20=160 μΩ·cm, ρ800/ρ20=1.0)

*Dimensions: k=0.22 mm, CL1=10 mm, d1=1.7 mm, P=1.0 mm, N=10 and electric resistance RH of the overall rubber at 20° C. is 1 Ω.

(Control Coil 23)

*Material: cobalt-iron alloy (composition: Fe=8 wt %; Co=balance, ρ20=8 μΩ·cm, ρ800/ρ20=9.8, the resistance is raised in the form of a downward convex as the temperature is raised until the temperature is raised to 800° C.)

*Dimensions: k=0.2 mm, CL2=15 mm, d1=1.7 mm, P=0.5 mm, N=30 and electric resistance RC of the overall body of the coil at room temperature is 0.33 Ω.

*(RH/RC) RT: 3

*(RH/RC) 800: 0.3

(Gap 25 between Coils)

*JL=2 mm (Sheath Tube 11)

*Material: SUS310S

*Dimensions: D1=3.5 mm, t=0.5 mm, t/D1=0.14 mm, CG=0.4 mm, outer diameter D3 of the enlarged-diameter portion=4.4 mm, L2=36 mm (Main metal shell 3)

*Material: carbon steel for machine structural use (S45C)

*Dimensions: length L3 of a portion (hereinafter called a "main portion 5") positioned more adjacent to the leading end than the thread portion 7 is 53 mm, outer diameter D4 of main portion 5 is 8.2 mm, length L4 of thread portion 7 is 27 mm and outer diameter D5 of thread portion 7 is 10 mm.

The operation of the glow plug 1 shown in FIG. 1 will now be described.

The glow plug 1 is joined to a cylinder block of the diesel engine at the thread portion 7 of the main metal shell 3 thereof. Thus, the leading end of the sheath tube 11 accommodating the heating coil 21 and the control coil 23 is located in a combustion chamber (or a sub-combustion chamber) of the engine. When voltage supplied from a battery mounted on the vehicle and serving as a power source is applied to the energizing terminal shaft 13 in the state, electric power is supplied in a passage formed sequentially as energizing terminal shaft 13→control coil 23→heating coil 21→sheath tube 11→main portion 5→(grounded through an engine block).

In the initial stage of energization, the temperature of the control coil 23 of the sheath heater 2 of the glow plug 1 is low. Therefore, the control coil 23 has low electric resistance. Thus, a relatively large electric current passes through the heating coil 21 so that the temperature of the heating coil 21 is rapidly raised. When the temperature of the heating coil 21 is raised, the control coil 23 is heated with the heat of the heating coil 21. Thus, the electric resistance of the control coil 23 is raised, causing the value of the electric current which is supplied to the heating coil 21 to be reduced. As a result, a temperature rising characteristic of the heater is shown such that the temperature is rapidly raised in the initial stage of energization. Then, the supply of the electric current is prevented by the operation of the control coil so that the temperature is saturated.

The main body 11*a* of the sheath tube 11 is formed into the cylindrical shape having a substantially constant outer diameter D1. Moreover, D1 is made to be 4.4 mm or smaller. Therefore, the excess-rise-preventive temperature rising characteristic, that is, a characteristic exhibiting an excellent quick heating characteristic can stably be realized with which the difference TP−TS between the peak temperature TP and the temperature TS realized after a lapse of 60 seconds is 50° C. to 200° C., the peak temperature TP is 900° C. to 1150° C. and energizing time t800 required for the temperature to be raised to 800° C. is 8 seconds or shorter.

The thickness t of the sheath tube 11 is 0.3 mm to 0.75 mm. Moreover, the value of t/D1 on an assumption that the outer diameter is D1 is 0.08 to 0.2. Therefore, required heating performance can be realized even if the heater has a small diameter. Moreover, the sheath tube 11 has sufficiently large strength. Even if the heater is dropped during, for example, a joining operation, the heater is not easily broken. The radius difference CG between the inner diameter of the main body 11*a* of the sheath tube 11 and the outer diameter of each of the heating coil 21 and the control coil 23 satisfies the range from 0.1 mm to 0.8 mm. Therefore, short circuit does not easily occur between the inner surface of the sheath tube 11 and the coils 21 and 22. Therefore, the manufacturing yield can be improved.

It is preferable that the ratio CL1/D1 of the coil length CL1 of the heating coil 21 and the outer diameter D1 of the main body of the sheath tube 11 shown in FIG. 2 is 1.6 to 3.5 (in this embodiment, it is about 2.5). Since the sheath tube 11 has a small diameter, heat radiation from the surface of the tube is enhanced as compared with the conventional sheath heater having a large diameter. Therefore, if CL1/D1 is smaller than 1.6, the length of the heating zone of the heating coil 21 is too small to obtain satisfactory heating performance. What is worse, the control coil cannot stably be heated. Therefore, a satisfactory excess-rise-preventive temperature rising characteristic cannot sometimes be obtained. If the CL1/D1 is larger than 4, there sometimes arises a problem in that the leading end of the sheath tube is not a portion generating a highest temperature.

Figure 4:
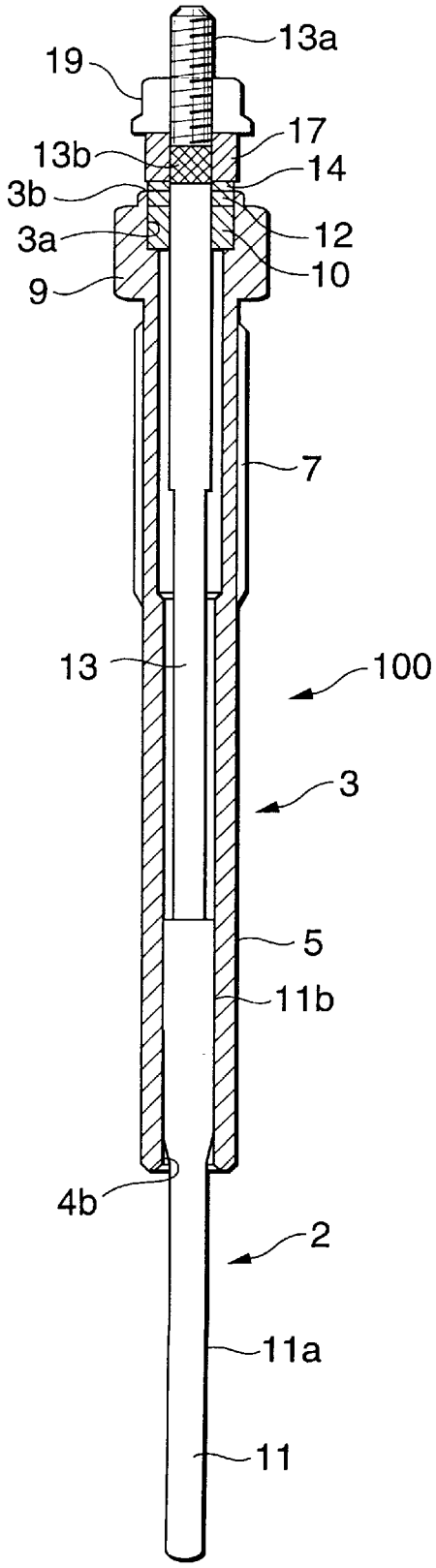
FIG. 4 is a vertical cross sectional view showing a modification of the glow plug shown in FIG. 1.

FIG. 4 shows a modification of the glow plug 1 shown in FIG. 1 (note that common elements are given the same reference numerals and the common elements are omitted from description). In the glow plug 100, the enlarged-diameter portion 11*b* of the sheath tube 11 formed adjacent to the base end of the same is made to be longer than that of the glow plug 1 shown in FIG. 1. The through hole 4 of the main metal shell 3 in the projection of the sheath tube 11 has not the enlarged-diameter portion 4*b* shown in FIG. 1. Therefore, a straight shape is formed. The enlarged-diameter portion 11*b* of the sheath tube 11 is joined to the through hole 4 by brazing.

A countersunk portion 3*a* similar to that shown in FIG. 1 is provided for the opposite opening formed in the through hole 4. A seal ring (made of, for example, silicon rubber) 10 and a washer-type first insulating ring (made of heat resisting resin, such as bakelite) 12 are fit to the countersunk portion 3*a* in place of the insulating bushing 16 shown in FIG. 1. In this state, a cylindrical projection formed at the edge of the opening of the countersunk portion 3*a* is crimped to the second insulating ring 14 so that a knurled portion 13*b* is formed. Moreover, a second insulating ring 14 (same material and same shape as those of the first insulating ring 12) and a retaining ring 17 are, in this sequential order, joined and secured to the energizing terminal shaft 13 at a position in the rear of the knurled portion 13*b*.

Figure 5:
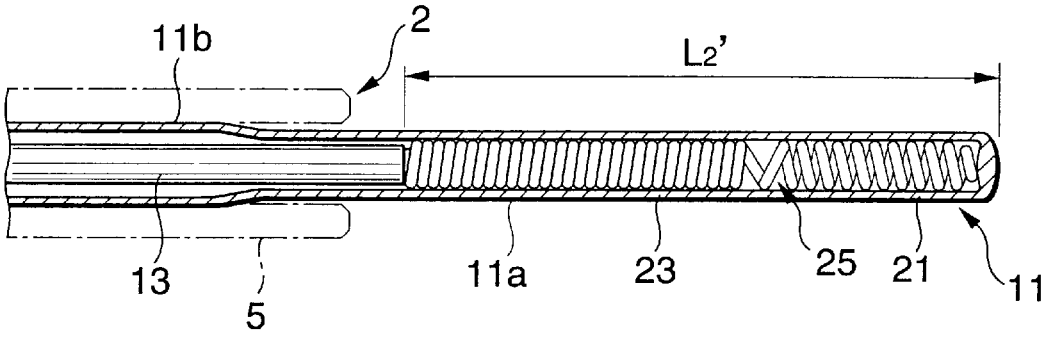
FIG. 5 is a cross sectional view showing the internal structure of a sheath tube of the glow plug.

As shown in FIG. 5, the leading end of the energizing terminal shaft 13 projects over the corresponding end of the opening of the main portion 5. The length L2' from the leading end of the energizing terminal shaft 13 to the leading end of the sheath tube 11 is 24 mm to 50 mm (preferably 24 mm to 42 mm).

The glow plug 100 attains the following effect. That is, the leading end of the energizing terminal shaft 13 is introduced into the projection of the sheath tube 11 over the main metal shell 3. As a result, the portion of the sheath tube 11 which is in contact with the inner edge of the opening of the main metal shell 3 can be reinforced by the energizing terminal shaft 13, the contact portion being a portion to which strong bending force is exerted when lateral force is applied. As a result, breakage can satisfactorily be prevented even if a shock or the like is exerted.

On the other hand, the glow plug 1 shown in FIG. 1 is superior to the glow plug 100 shown in FIG. 4 from the following viewpoint. The structure is formed such that the rear end portion of the energizing terminal shaft 13 is fixed by the retaining ring 17 through the insulating bushing 16. Therefore, the number of required elements can be reduced and manufacturing can be facilitated as compared with the glow plug 100 shown in FIG. 4 and structured such that the first insulating ring 12 and the seal rig 10 are crimped by the crimping portion 3*b*; and the second insulating ring 14 and the retaining ring 17 are used for reinforcement. The glow plug 100 shown in FIG. 4 has the structure that the distance from the inner edge of the crimping portion 3*b* projecting inwards to the outer surface of the energizing terminal shaft 13 is relatively short. Therefore, airtightness between the insulating rings 12 and 14 must be established to prevent short circuit caused from wetting or the like. On the other hand, the glow plug 1 shown in FIG. 1 incorporates the flange portion 16*a* of the insulating bushing 16 which elongates the distance from the inner edge of the opening of the main metal shell 3 to the outer surface of the energizing terminal shaft 13. Moreover, introduction of water into the portion including the energizing terminal shaft 13 through the gap between the insulating bushing 16 and the main metal shell 3 can be prevented by the "O" ring 15. Therefore, short circuit does not easily occur. The glow plug 100 shown in FIG. 4 has the structure that the sheath tube 11 is joined to the main metal shell 3 by brazing. Therefore, design of the strength must be performed such that softening of the sheath tube 11 caused by an influence of the heat generated during the brazing operation is estimated. On the other hand, the glow plug 1 shown in FIG. 1 has the structure that the sheath tube 11 is press-fit into the main metal shell 3. Therefore, there is no apprehension of softening caused from the influence of heat. Thus, an advantage can be realized in that the effect of improving the strength by performing the machining process can effectively be achieved.

EXAMPLES (Example 1)

A variety of glow plugs shown in FIG. 1 having the above-mentioned dimensions and made of the materials were manufactured except for the following specific conditions. Only the outer diameter D1 of the main body 11*a* of the sheath tube 11 were made to be to be 2.5 mm to 5.0 mm. To correspond to this, only the outer diameter d1 of each of the heating coil 21 and the control coil 23 were varied in a range from 1.5 mm to 2.5 mm. As an alternative to the cobalt-iron alloy, the materials of the control coil 23 were a nickel-plated iron wire (having the same diameter and the thickness of plating was about 1 $\mu$m) and a nickel wire (having the same diameter).

Figure 10:
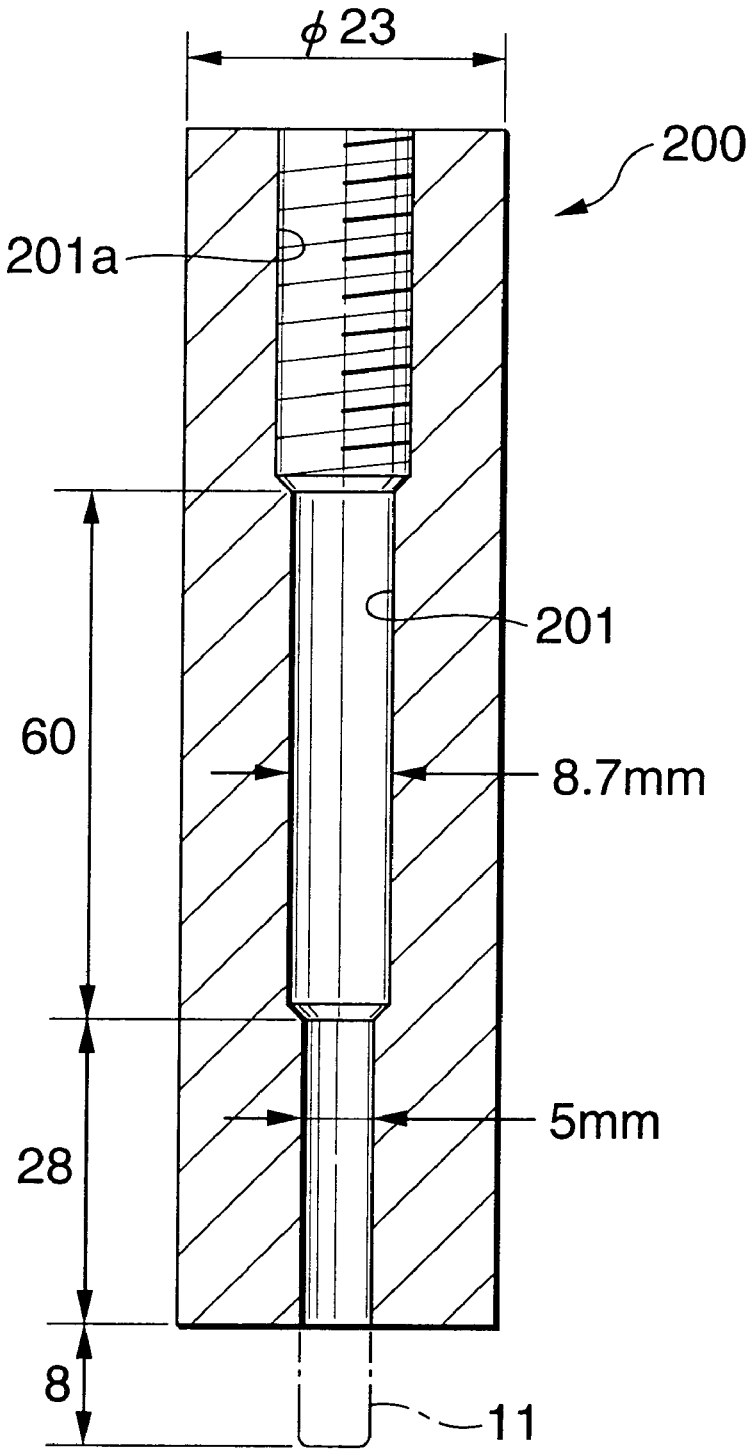
FIG. 10 is a vertical cross sectional view showing a jig for use in measuring the temperature of the glow plug.

The glow plug was allowed to stand at room temperature, and then a voltage of 11 V was applied to obtain temperature rising curves (temperature-time curves) as follows: the temperature was measured in a state in which the glow plug 1 was joined to a jig 200 structured as shown in FIG. 10. The jig 200 was made of carbon steel formed into an elongated cylindrical shape (having an outer diameter of 23 mm). A plug receiving hole 201 was formed in the axial direction in the central portion of the jig 200. The glow plug 1 shown in FIG. 1 was joined to the jig 200 by inserting the leading end of the glow plug 1 into the plug receiving hole 201. Then, the thread portion 7 was joined to a female thread portion 201*a* formed at an end portion of the plug receiving hole 201. The dimensions of the jig 200 were as illustrated (unit: mm). The leading end of the sheath tube 11 of the glow plug 1 projected over the end surface of the jig 200 by 8 mm in the joined state.

A measuring region from the leading end of the projection of the sheath tube 11 to a position apart from the leading end for a distance of 8 mm was determined. A position at which a highest temperature was realized in the measuring region was previously detected. Moreover, a thermocouple (Pt/Pt–Rh) was secured to the position, and then electric power was continuously supplied to the sheath heater 2 to detect change in the temperature as time elapsed. Thus, temperature rising characteristic curves were obtained (the measuring method conformed to the method regulated in ISO7578 (1986)). In accordance with the obtained temperature rising curves, the time (t800) required for the temperature to be raised to 800° C., the peak temperature (TP) and the temperature (TP) realized after 60 seconds have passed were calculated. Results were shown in Table 1.

TABLE 1

| No. | Material of heating coil | Material of Control coil | D1 (mm) | d1 (mm) | t800 (sec) | Tp (° C.) | Ts (° C.) | Tp – Ts (° C.) |
|---|---|---|---|---|---|---|---|---|
| 1 | Fe—Cr | Co—Fe | 5.0 | 2.5 | 6.5 | 1050 | 1050 | 0 |
| 2 | Fe—Cr | Co—Fe | 4.4 | 2.0 | 5.5 | 980 | 930 | 50 |
| 3 | Fe—Cr | Co—Fe | 4.4 | 2.2 | 5.0 | 1000 | 920 | 80 |
| 4 | Fe—Cr | Co—Fe | 4.0 | 2.0 | 4.5 | 1020 | 920 | 100 |
| 5 | Fe—Cr | Co—Fe | 3.5 | 1.8 | 3.5 | 1050 | 930 | 120 |
| 6 | Fe—Cr | Co—Fe | 3.0 | 1.7 | 3.2 | 1080 | 930 | 150 |
| 7 | Fe—Cr | Co—Fe | 2.5 | 1.5 | 3.0 | 1150 | 900 | 250 |
| 8 | Fe—Cr | Ni-plated Fe | 3.5 | 1.8 | 3.5 | 1050 | 970 | 80 |
| 9 | Fe—Cr | Ni-plated Fe | 3.0 | 1.7 | 3.2 | 1080 | 960 | 120 |
| 10 | Fe—Cr | Ni | 3.5 | 1.8 | 3.5 | 1050 | 1000 | 50 |

*mark designates out of the present invention (No. 1 and No. 7)

That is, a glow plug designated by the number 1 and incorporating the main body 11*a*, the outer diameter D1 of which was larger than 4.4 mm, had a large value of t800. Therefore, the quick heating characteristic was insufficient. Moreover, temperature TS (on which the saturated temperature was reflected) realized after a lapse of 60 seconds was low. Also the value of TP–TS was lower than 50° C.

Therefore, a satisfactory excess-rise-preventive temperature rising characteristic was not obtained. On the other hand, glow plugs (designated by numbers 2 to 6 and 8 to 10) each incorporating the sheath heater according to the present invention and having the main body 11*a*, the outer diameter D1 of which was 3 mm to 4.4 mm, had small values of t800. Therefore, an excellent quick heating characteristic was realized. Moreover, excellent excess-rise-preventive temperature rising characteristics were obtained. On the other hand, each of the glow plugs having the main body 11*a*, the outer diameter D1 of which was smaller than 3 mm, incorporated a small heating coil. Therefore, temperature TS after a lapse of 60 seconds was too low to realize the performance required for the glow plug.

Figure 6:
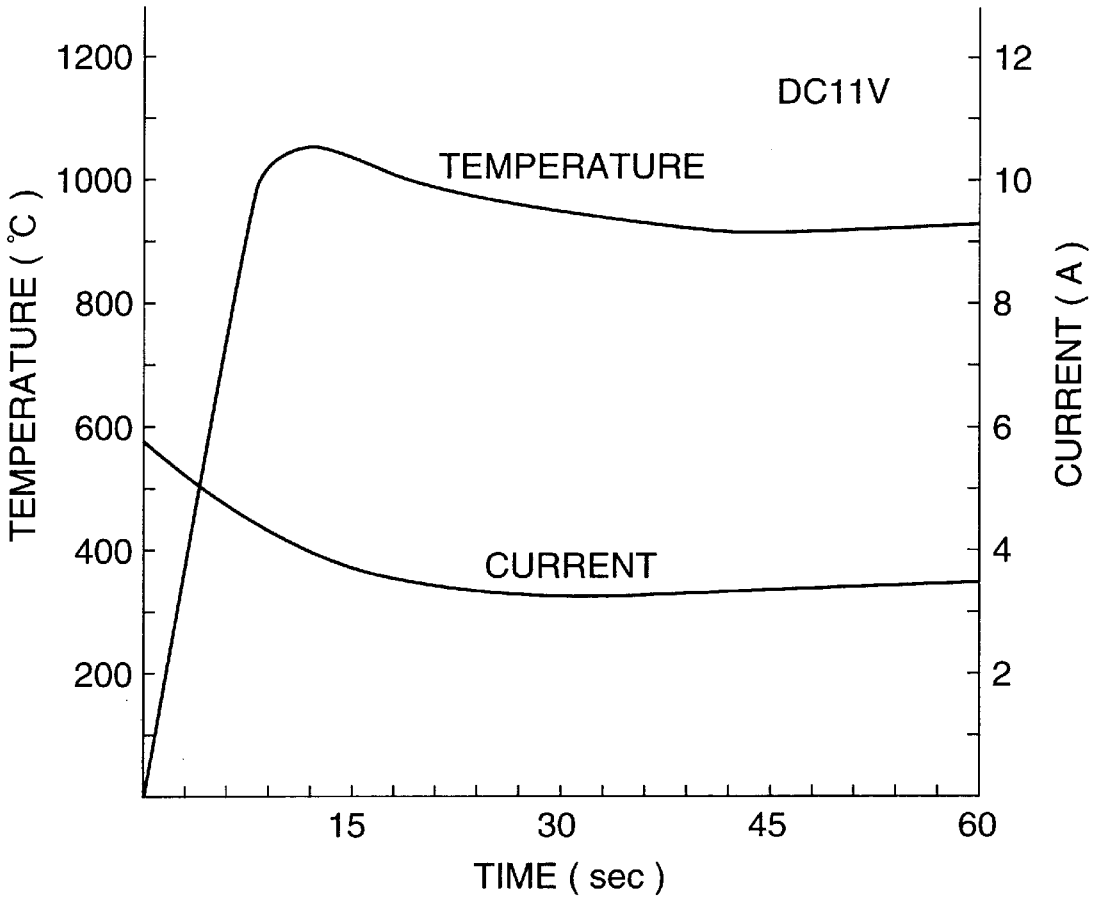
FIG. 6 is a graph showing a temperature rising curve of glow plug number 5 according to Example 1.

FIG. 6 shows a temperature rising curve of the glow plug designated by the number 5. FIG. 7 shows a temperature rising curve of the glow plug designated by the number 1 and according to the comparative example.

(Example 2)

A variety of the glow plugs shown in FIG. 1 having the same dimensions and made of the same materials were manufactured except for the gap length JL between coils which were varied in a range from 0.5 mm to 5 mm. Similarly to Example 1, temperature rising curves (temperature-time curves) of the glow plugs were obtained to calculate values of t800, TP and TS. Results were shown in Table 2.

TABLE 2

| No. | JL (mm) | t800 (° C.) | Tp (° C.) | Ts (° C.) |
|---|---|---|---|---|
| 21 | 5 | 3.0 | 1100 | 1050 |
| 22 | 3 | 3.2 | 1080 | 1000 |
| 23 | 2 | 3.5 | 1050 | 930 |
| 24 | 1 | 3.8 | 1000 | 920 |
| 25 | 0.8 | 4.5 | 980 | 910 |
| 26 | 0.5 | 5.5 | 920 | 900 |

That is, JL was varied in a range from 0.8 mm to 3 mm so that glow plugs each having an excellent quick heating characteristic and an excess-rise-preventive temperature rising characteristic were realized.

(Example 3)

A variety of the glow plugs shown in FIG. 1 having the above-mentioned dimensions and made of the above-mentioned materials were manufactured except for the following specific conditions. That is, the outer diameter D1 of the main body 11*a* of the sheath tube 11 of each glow plug was varied in a range from 3.0 mm to 4.4 mm. The thickness t of the main body 11*a* was varied in a range from 0.25 mm to 0.70 mm. Only the outer diameter d1 of each of the heating coil 21 and the control coil 23 was varied in a range from 1.5 mm to 3.0 mm. The specific values of D1, t and d1 of each glow plug were shown in Table 3 together with the values of t/D1, D2 (the inner diameter of the sheath tube), CG (the radius difference between the coil and the inner surface of the sheath tube) and d1/D2.

Fifty glow plugs satisfying each of the conditions were manufactured so as to be subjected to the following tests. Results were shown in Table 3.

(1) Probability of Occurrence of Short Circuit

A pulse voltage (having a pulse length of 0.1 second) of 50 V was applied to each glow plug at room temperature to measure the level of the resistance of the glow plug. A result of the measurement was assumed to be R0. Then, a voltage of 11 V was continuously applied for 30 seconds, and then a similar pulse voltage was applied. Thus, the level of the resistance of each glow plug was measured. A result of the measurement was assumed to be R1. If short circuit occurs between the sheath tube and the heating coil/control coil due to heat, a substantial length of energized coil is shortened. Therefore, the measured resistance R1 is lowered. If a reduction ratio $\{R0-R1)/R0\}\times100$ of R1 and R0 is not lower than 10%, a determination was made that short circuit occurred. If the fifty glow plugs were free from short circuit, the glow plugs were accepted glow plugs (marked "A": excellent). If one or more glow plugs encountered short circuit, the shorted glow plug(s) was(were) picked up (marked "B": acceptable).

(2) Evaluation of Strength (I)

Each glow plug was vertically held such that the sheath tube faced downwards and the initial distance from a concrete surface to the leading end of the sheath tube was 1 cm. Then, each glow plug was dropped, and then the distance was sequentially enlarged by 1 cm to repeat the dropping operation. After the dropping operation was completed, whether or not each sheath tube encountered bending and breakage was visually determined. Glow plugs free from breakage when the height from which the dropping operation was performed was 5 cm or greater were evaluated as excellent (A), 3 cm to 4 cm were evaluated as good (B) and 2 cm smaller was evaluated as acceptable (C).

(3) Evaluation of Strength (II)

Figure 8:
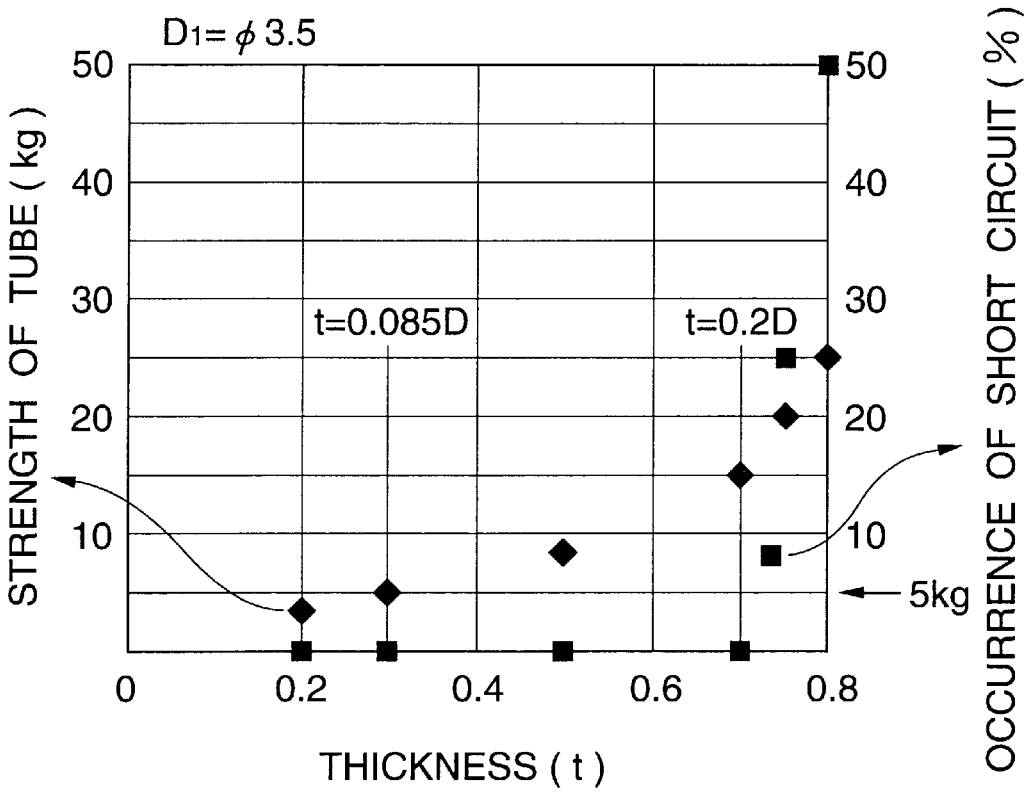
FIG. 8 is a graph showing results of bending strength tests of Example 3 together with probabilities of occurrence of short circuit.
Figure 9:
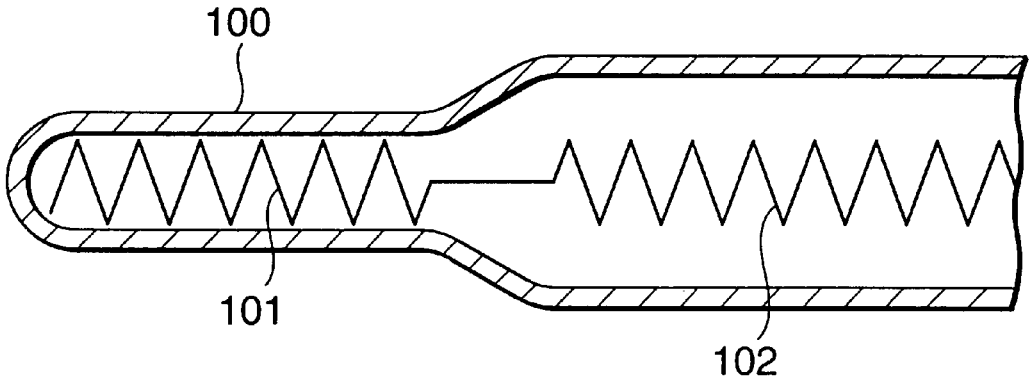
FIG. 9 is a schematic view showing a conventional glow plug.

The main metal shell of each glow plug was held by a chuck such that the sheath tube was positioned horizontally, and then the glow plug was mounted on a bending testing machine. Moreover, the leading end of a bending punch was brought into contact with a position apart from the leading end of the sheath tube on the projected side for a distance of 1 mm in the axial direction. Then, a cantilever bending test was performed at speed of the cross head of 1 mm/minute to measure a maximum bending load. The obtained value was employed as a bending strength. The outer diameter D1 of the main body 11*a* of the sheath tube 11 was fixed to 3.5 mm to vary the thickness t so as to measure the strength. A graph formed by plotting the strength values and the probability of occurrence of short circuit is shown in FIG. 8.

TABLE 3

| No. | D1 (mm) | t (mm) | t/D1 | D2 (mm) | d1 (mm) | CG (mm) | d1/D2 | Short Circuit | Strength |
|---|---|---|---|---|---|---|---|---|---|
| 31 | 3.50 | 0.25 | 0.07 | 3.00 | 1.90 | 0.55 | 0.63 | A | C |
| 32 | 3.50 | 0.35 | 0.10 | 2.80 | 1.90 | 0.45 | 0.68 | A | B |
| 33 | 3.50 | 0.50 | 0.14 | 2.50 | 1.90 | 0.30 | 0.76 | A | A |
| 34 | 3.50 | 0.65 | 0.19 | 2.20 | 1.90 | 0.15 | 0.86 | A | A |
| 35 | 3.50 | 0.75 | 0.21 | 2.00 | 1.90 | 0.05 | 0.95 | B | A |
| 36 | 4.40 | 0.75 | 0.17 | 2.90 | 1.90 | 0.50 | 0.65 | A | A |
| 37 | 4.40 | 0.35 | 0.19 | 3.70 | 1.90 | 0.90 | 0.51 | B | B |
| 38 | 4.40 | 0.50 | 0.11 | 3.40 | 3.00 | 0.20 | 0.83 | A | A |
| 39 | 3.00 | 0.40 | 0.13 | 2.20 | 1.90 | 0.15 | 0.86 | A | A |
| 40 | 3.00 | 0.40 | 0.13 | 2.20 | 1.50 | 0.35 | 0.68 | A | A |

The following facts can be understood from the results shown in Table 3.

(1) When the thickness t is 0.3 mm or greater and the value of t/D1 is 0.08 or greater, the sheath tube has sufficient strength to be free from frequent occurrence of breakage in the drop test.

(2) When the clearance CG is 0.1 mm to 0.8 mm, short circuit does not easily occur.

To prevent breakage in the drop test, the value of t/D1 must be 0.08 or greater. As can be understood from the results shown in FIG. 8, the corresponding strength must be 5 kg or greater. If the value of t/D1 is larger than 0.2, the probability of occurrence of short circuit was rapidly raised.

What is claimed is:

1. A glow plug comprising:

a sheath tube having a closed leading end;

a cylindrical main metal shell disposed on an exterior surface of said sheath tube, said sheath tube having a projecting portion at a leading end of said sheath tube projecting beyond an end of said main metal shell; and a plurality of resistance-wire coils disposed in an axial direction in said sheath tube, said plurality of resistance-wire coils including a heating coil and a control coil in said projecting portion, said heating coil being disposed adjacent to the leading end of the projecting portion, said control coil being connected to a rear end of said heating coil in series and arranged to be heated by said heating coil to raise electrical resistance of said control coil so as to control a supply of electric power to said heating coil;

wherein said projecting portion of said sheath tube has a substantially uniform outer diameter along the axial direction of said projecting portion and the outer diameter of said projecting portion is in a range of 3.0 mm to 4.4 mm so that a temperature rising characteristic at an exterior surface of the leading end of said sheath tube has a peak temperature TP in an initial stage of energization and saturates at a temperature not higher than the peak temperature TP.

2. The glow plug according to claim 1, wherein said control coil is directly connected to the rear end of said heating coil at a position spaced apart from the rear end of said heating coil to form a gap larger than each of a plurality of pitches of winding of a wire forming said heating coil, and wherein a length of the gap is in a range of 1 mm to 3 mm.

3. The glow plug according to claim 1, wherein the peak temperature TP is 800° C. or higher and energizing time t800 required for the temperature to be raised to 800° C. is 8 seconds or shorter when the temperature rising characteristic is measured with an applied voltage of 11 V starting at room temperature.

4. The glow plug according to claim 1, wherein a difference TP−TS between the peak temperature TP and temperature TS realized 60 seconds after the energization is started is in the range of 50° C. to 200° C. when the temperature rising characteristic is measured with an applied voltage of 11 V starting at room temperature.

5. The glow plug according to claim 1, wherein the peak temperature TP is 900° C. to 1150° C.

6. The glow plug according to claim 1, wherein a wall thickness t of said projecting portion of said sheath tube beyond the end of said main metal shell is 0.3 mm to 0.75 mm and a value of t/D1 is 0.08 to 0.2 where the outer diameter of said projecting portion is D1.

7. The glow plug according to claim 1, wherein for an inner diameter of said projecting portion of said sheath tube of D2 and an outer diameter of each of said heating coil and said control coil of d1, a difference CG=(D2−d1)/2 between two radii is in a range of from 0.1 mm to 0.8 mm.

8. The glow plug according to claim 1, wherein an outer diameter d1 of each of said heating coil and said control coil is 1.5 mm to 3.0 mm and a ratio d1/D2 of said outer diameter d1 to an inner diameter D2 of said projecting portion of said sheath tube is in a range of from 0.5 to 0.8.

9. The glow plug according to claim 1, wherein said sheath tube is made of any one of stainless steel, iron-base heat resisting alloy and Ni-base heat resisting alloy.

10. The glow plug according to claim 1, wherein a length of said projecting portion of said sheath tube beyond an end of said main metal shell is 24 mm to 50 mm.

11. The glow plug according to claim 10, wherein a leading end of an energizing terminal shaft inserted from a base end of said sheath tube is, in said sheath tube, connected to a rear end of said resistance wire coils, the leading end of said energizing terminal shaft projects beyond an end surface of said main metal shell and a length from the leading end of said energizing terminal shaft to a leading end of said sheath tube is in a range of 24 mm to 50 mm.

12. The glow plug according to claim 1, wherein an inner diameter of an opening formed in said main metal shell for accommodating said sheath tube is larger than the outer diameter of the projecting portion of said sheath tube beyond said main metal shell, a diameter of a base end of said sheath tube is enlarged to correspond to the inner diameter of said opening formed in said main metal shell and said base end, the diameter of which is enlarged, is joined to an inside portion of said opening of said main metal shell by brazing, welding or press fitting.

13. A glow plug comprising:

a sheath tube having a closed leading end; and a heating coil disposed in said sheath tube at a leading end portion of said sheath tube;

wherein said sheath tube has a heating-coil accommodating portion for accommodating said heating coil, an outer diameter of said heating-coil accommodating portion is in a range of 3.0 mm to 4.4 mm, wall thickness t of said heating-coil accommodating portion is in a range of 0.3 mm to 0.75 mm and a value of t/D1, where the outer diameter of said heating-coil accommodating portion is D1, is 0.08 to 0.2.

14. The glow plug according to claim 13, wherein a control coil is disposed in an axial direction in said sheath tube and is connected in series to a rear end of said heating coil and arranged to be heated by said heating coil so as to raise electrical resistance so as to control a supply of electric power to said heating coil.

15. The glow plug according to claim 14, wherein a temperature rising characteristic of a surface of the closed leading end of said sheath tube is made such that peak temperature TP exists in an initial stage of energization and a temperature is saturated at a temperature not higher than the peak temperature TP.

16. The glow plug according to claim 13, wherein an outer diameter d1 of said heating coil is in a range of 1.5 mm to 3.0 mm and a ratio d1/D2 of said outer diameter d1 and an inner diameter D2 of said heating-coil accommodating portion is in a range of 0.5 to 0.8.

17. The glow plug according to claim 13, wherein said sheath tube is made of any one of stainless steel, iron-base heat resisting alloy and Ni-base heat resisting alloy.

18. The glow plug according to claim 13, wherein a main metal shell for covering said sheath tube is provided such that the leading end of said sheath tube projects beyond an end of said main metal shell, and a length of a projecting portion of said sheath tube beyond an end of said main metal shell is in a range of 24 mm to 50 mm.

19. The glow plug according to claim 13, wherein a leading end of an energizing terminal shaft inserted from a base end of said sheath tube is, in said sheath tube, connected to a rear end of a control coil, the leading end of said energizing terminal shaft projects beyond an end surface of a main metal shell surrounding said sheath tube and a length from the leading end of said energizing terminal shaft to the leading end portion of said sheath tube is in a range of 24 mm to 50 mm.

20. The glow plug according to claim 13, wherein an inner diameter of an opening formed in a main metal shell for accommodating said sheath tube is larger than diameter of a projecting portion of said sheath tube beyond an end of said main metal shell, a diameter of a base end of said sheath tube is enlarged to correspond to an inner diameter of said opening formed in said main metal shell and said base end, a diameter of which is enlarged, is joined to an inside portion of said opening of said main metal shell by brazing, welding or press fitting.

21. A glow plug comprising:

a sheath tube having a closed leading end and a heating-coil accommodating portion; and a heating coil disposed in said sheath tube at a leading end portion of said sheath tube, wherein an outer diameter of said heating-coil accommodating portion for accommodating said heating coil is 3.5 mm to 4.4 mm and where an inner diameter of said heating-coil accommodating portion is D2 and an outer diameter of said heating coil is d1, a radius difference CG=(D2−d1)/2 is in a range of from 0.1 mm to 0.8 mm.

22. The glow plug according to claim 21, wherein the outer diameter of said heating-coil accommodating portion of said sheath tube is 3.0 mm to 4.4 mm, a wall thickness t of said heating-coil accommodating portion is 0.3 mm to 0.75 mm and where the outer diameter of said heating-coil accommodating portion is D1, a value of t/D1 is in a range of from 0.08 to 0.2.

23. The glow plug according to claim 22, wherein a temperature rising characteristic of a surface of a leading end portion of said sheath tube is made such that peak temperature TP exists in an initial stage of energization and a temperature is saturated at a temperature not higher than the peak temperature TP.

24. The glow plug according to claim 21, wherein a control coil is disposed in an axial direction in said sheath tube; and said control coil is connected in series to a rear end of said heating coil and arranged to be heated by said heating coil so as to raise electrical resistance so as to control a supply of electric power to said heating coil.

25. The glow plug according to claim 21, wherein the outer diameter d1 of said heating coil is in a range of 1.5 mm to 3.0 mm and a ratio d1/D2 of the outer diameter d1 and the inner diameter D2 of said heating-coil accommodating portion is in a range of 0.5 to 0.8.

26. The glow plug according to claim 21, wherein said sheath tube is made of any one of stainless steel, iron-base heat resisting alloy, and Ni-base heat resisting alloy.

27. The glow plug according to claim 21, wherein a main metal shell for covering said sheath tube is provided such that the leading end of said sheath tube projects beyond an end of said main metal shell, and a length of the projecting portion of said sheath tube beyond the end of said main metal shell is in a range of 26 mm to 50 mm.

28. The glow plug according to claim 21, wherein a main metal shell for covering said sheath tube is provided such that the leading end of said sheath tube projects beyond an end of said main metal shell, wherein a control coil is disposed in an axial direction in said sheath tube, and wherein the leading end of an energizing terminal shaft inserted from a base end of said sheath tube is, in said sheath tube, connected to the rear end of said control coil, the leading end of said energizing terminal shaft projects beyond an end surface of said main metal shell, and the length from the leading end of said energizing terminal shaft to the leading end of said sheath tube is in a range of 24 mm to 50 mm.

29. The glow plug according to claim 21, wherein the inner diameter of an opening formed in a main metal shell for accommodating said sheath tube is larger than a diameter of a projecting portion of said sheath tube beyond an end of said main metal shell, a diameter of a base end of said sheath tube is enlarged to correspond to the inner diameter of said opening formed in said main metal shell and said base end, a diameter of which is enlarged, is joined to an inside portion of said opening of said main metal shell by brazing, welding or press fitting.

* * * * *

UNITED STATES PATENT AND TRADEMARK OFFICE

CERTIFICATE OF CORRECTION

PATENT NO. : 6,064,039
DATED : May 16, 2000
INVENTOR(S) : Chiaki KUMADA

It is certified that error appears in the above-identified patent and that said Letters Patent is hereby corrected as shown below:

Item [75] ADDRESS OF INVENTOR:

Please change "Gifu, Japan" to --Gifu-shi, Japan--.

Column 19, line 1, after "than" insert --a--.

Signed and Sealed this

Tenth Day of April, 2001

Nicholas P. Godici

*Attest:*

NICHOLAS P. GODICI

*Attesting Officer*

*Acting Director of the United States Patent and Trademark Office*